United States Patent [19]

Shiina

[11] 3,997,985

[45] Dec. 21, 1976

[54] STRETCHABLE SHOE

[76] Inventor: Atsuyoshi Shiina, No. 1060 Shimosakunobe, Takatsu, Kawasaki, Japan

[22] Filed: Aug. 22, 1975

[21] Appl. No.: 607,054

[52] U.S. Cl. ..... 36/97

[51] Int. Cl.[2] ..... A43B 3/26

[58] Field of Search ..... 36/2.5 R, 2.5 B, 7.5, 36/7.6, 97

[56] References Cited

UNITED STATES PATENTS

| | | | |
|---|---|---|---|
| 2,009,684 | 7/1935 | Affronte | 36/2.5 B |
| 2,497,175 | 2/1950 | Mantos | 36/2.5 B |
| 3,389,481 | 6/1968 | England | 36/2.5 B |

*Primary Examiner*—Patrick D. Lawson
*Attorney, Agent, or Firm*—Michael J. Striker

[57] ABSTRACT

A stretchable shoe comprising a front member and a rear member may be adjusted in length. The front member and the rear member are separable and interconnected by a screw which passes through one hole of the front member and one of a plurality of holes of the rear member. The front member is composed of an upper, an insole, a middle plate and a bottom plate, and the rear member is composed of a sole, an upper and a heel. The stretchable shoe is especially available for a growing child.

8 Claims, 8 Drawing Figures

STRETCHABLE SHOE

This invention relates to a stretchable shoe.

The primary object of this invention is to provide a long term shoe for use by a growing child.

Another object of this invention is to provide a shoe which can be used by children; having feet of different lengths.

Still another object of this invention is to provide a shoe for an adult in which various front members can be used.

Heretofore, a child could not wear the same pair of shoes for any extended period of time due to the rapid growth of the child. This invention contemplates improving the traditional shoe.

According to this invention, a shoe comprises a front member and a rear member which are able to separate at a plantar arch portion of the shoe and to be joined by a screw so as to adjust the length of the shoe to a foot of the wearer.

This invention will be better understood and other objects and additional advantages of this invention will become apparent upon perusal of the following description taken in connection with drawings, in which.

Figure 1:
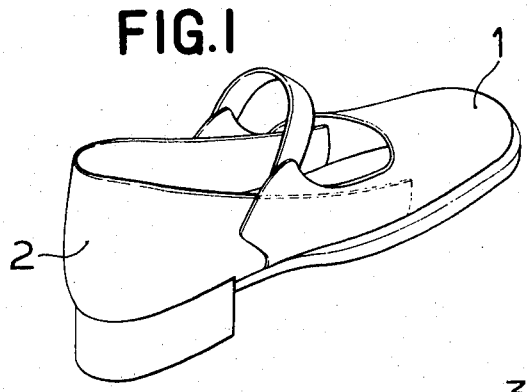
FIG. 1 is a perspective view of a shoe of this invention.
Figure 2:
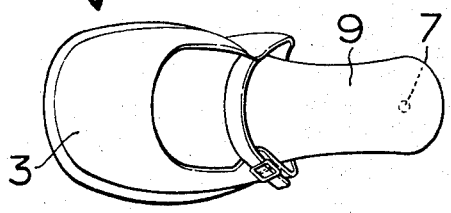
FIG. 2 is a plan view of the front member of the shoe.
Figure 5:
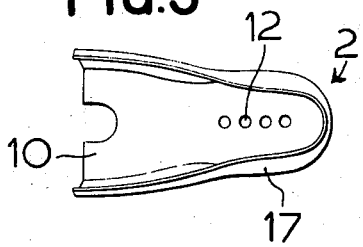
FIG. 5 is a plan view of the rear member of the shoe.
Figure 3:
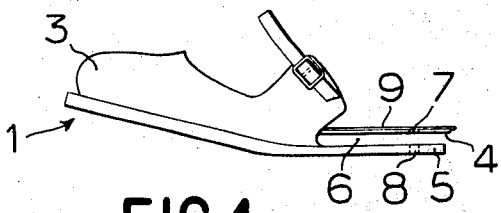
FIG. 3 is a side view of the front member of the shoe.
Figure 4:
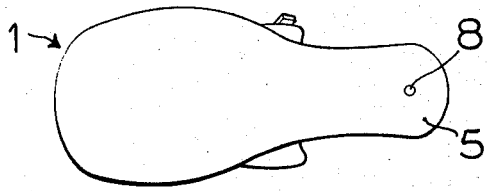
FIG. 4 is a bottom view of the front member of the shoe.
Figure 6:
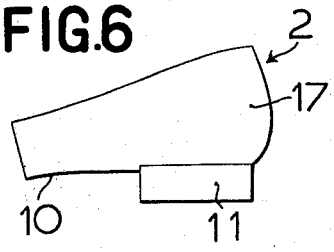
FIG. 6 is a side view of the rear member of the shoe.
Figure 7:
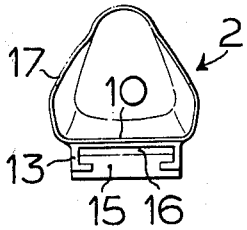
FIG. 7 is an inside elevational view of the rear member of the shoe.
Figure 8:
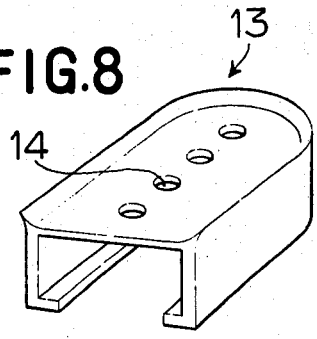
FIG. 8 is an enlarged perspective view of a horseshoe shaped box which is a part of the heel of the shoe.

Referring to the drawings, the shoe comprises front member 1 and a rear member 2 as shown in FIG. 1. The front member 1 is composed of an upper 3, an insole 9, a middle plate 4 and a bottom plate 5. There is a space between the middle plate 4 and the bottom plate 5. The insole 9, the middle plate 4 and the bottom plate 5 have each one of the holes 7 and 8 in corresponding positions, respectively. The rear member 2 is composed of a sole 10, an upper 17 and a heel 11. The heel 11 is composed of a horseshoe shaped box 13 and a heel leather 15. There is a space 16 between the horseshoe shaped box 13 and the heel plate 15. The horseshoe shaped box 13 is made from metal or plastics and is provided with a plurality of holes 14 aligned with a plurality of holes 12 on the sole 10.

The shoe of this invention comprises the members 1 and 2 and both members 1 and 2 are combined to form the shoe so that the sole 10 is inserted into a space 6 between the middle plate 4 and the bottom plate 5, and simultaneously the bottom plate 5 is inserted into a space 16 between the upper portion of the horseshoe shaped box 13 and the heel plate 15 which are parts of the heel 11. Through the hole 7 of the insole 9, one of the holes 12 of the sole 10, the hole 8 of the bottom plate 5 and one of the holes 14 of the horseshoe shaped box 13, a screw is passed so as to interconnect both members 1 and 2. In order to adjust the length of the shoe, a different one of the holes 12 of the sole 10 may be appropriately selected.

As described above, the displacement of the two members 1 and 2 can be easily achieved by passing a single screw through the proper holes to adjust the length of the shoe, therefore, the shoe may be used by a growing child and is durable and suited for use for a long time by adjusting the length of the shoe in accordance with growth of the feet of the child and also may be offered for common use by several children whose feet are different in length.

Inasmuch the shoe of this invention comprises the front and the rear members 1 and 2 and can be dismembered into said two members, if a plurality of various ornamentalized front members is associated with one rear member for use as an adult shoe, this has an advantage of variety that may otherwise be offered only by a plurality of shoes of different types.

The front member of the shoe may also be used as a slipper.

What is claimed as new and desired to be secured by Letters Patent of the United States is:

1. A longitudinally stretchable shoe, comprising a rear member having a sole and a heel; at least one front member; means for guiding said front member on said rear member for displacement longitudinally of the shoe between a plurality of spaced positions to thereby select a longitudinal dimension of the shoe, said guiding means including a middle plate and a bottom plate on said front member together bounding a first space for guiding said sole, and two portions of said heel bounding a second space for guiding said bottom plate; and means for arresting said front member in any of said spaced positions relative to said rear member.

2. A shoe as defined in claim 1, wherein said front and rear members merge with one another in a region located at a plantar arch of the shoe.

3. A shoe as defined in claim 1; wherein one of said portions of said heel is a heel plate; and wherein the other portion of said heel is a horseshoe-shaped box connected with said heel plate and with said sole.

4. A shoe as defined in claim 1, wherein one of said members is provided with a single set of aligned openings therethrough, and wherein the other member includes a plurality of sets of aligned openings; and wherein said arresting means includes an elongated screw passing through the openings of said members which are aligned with one another in a respective one of said spaced positions.

5. A shoe as defined in claim 4, wherein said front member includes an insole, a middle plate and a bottom plate; wherein said rear member includes a sole and a horseshoe-shaped box; and wherein said single set of openings is formed in said insole, said middle plate and said bottom plate whereas said plurality of sets of openings is provided in said sole and said horseshoe-shaped box.

6. A shoe as defined in claim 5, wherein each of said members further includes an upper, and said rear member further including a heel plate connected to said horseshoe-shaped box.

7. A longitudinally stretchable shoe, comprising a rear member having a sole and a heel, the latter including a horseshoe-shaped box and a heel plate; at least one front member having an insole, a middle plate and a bottom plate; means for guiding said front member on said rear member for displacement longitudinally of the shoe between a plurality of spaced positions to thereby select a longitudinal dimension of the shoe; and means for arresting said front member in any of said spaced positions relative to said rear member.

8. A longitudinally stretchable shoe set, comprising a rear member having a sole and a heel; a plurality of interchangeable front members; means for guiding a selected one of said front members on said rear member for displacement longitudinally of the shoe between a plurality of spaced positions to thereby select a longitudinal dimension of the shoe, said guiding means including a middle plate and a bottom plate on said selected front member together bounding a first space for guiding said sole, and two portions of said heel bounding a second space for guiding said bottom plate; and means for arresting said selected front member in any of said spaced positions relative to said rear member.

* * * * *